United States Patent [19]

Frykhult et al.

[11] 4,238,208

[45] Dec. 9, 1980

[54] APPARATUS FOR DEGASSING PAPER STOCK

[75] Inventors: Rune H. Frykhult, Huddinge; Hans O. G. Forsblom, Skarholmen, both of Sweden

[73] Assignee: AB Celleco, Stockholm, Sweden

[21] Appl. No.: 962,873

[22] Filed: Nov. 22, 1978

[30] Foreign Application Priority Data

Nov. 24, 1977 [SE] Sweden ..... 7713286

[51] Int. Cl.[3] ..... B01D 19/00

[52] U.S. Cl. ..... 55/169; 55/52; 55/189; 162/252; 162/380

[58] Field of Search ..... 55/190, 189, 194, 36, 55/52, 55, 164, 165, 169; 137/428; 209/211; 162/380, 49, 198, 263

[56] References Cited

U.S. PATENT DOCUMENTS

| | | | |
|---|---|---|---|
| 2,045,163 | 6/1936 | Raffles | 162/380 |
| 2,413,102 | 12/1946 | Ebert et al. | 55/52 |
| 2,685,937 | 8/1954 | Clark et al. | 55/52 |
| 2,738,026 | 3/1956 | Glasgow et al. | 55/52 |
| 3,206,917 | 9/1965 | Kaiser et al. | 162/380 |
| 3,421,622 | 1/1969 | Wurtman | 209/211 |
| 3,432,036 | 3/1969 | Kaiser | 55/194 |

FOREIGN PATENT DOCUMENTS

| | | | |
|---|---|---|---|
| 51-38759 | 10/1976 | Japan | 55/194 |

*Primary Examiner*—S. Leon Bashore
*Assistant Examiner*—Steve Alvo
*Attorney, Agent, or Firm*—Cyrus S. Hapgood

[57] ABSTRACT

The paper-making stock is fed continuously to a tank with two chambers separated by a partition having an opening for passage of stock from the first to the second chamber, evacuation means being provided for maintaining equally low gas pressures in the two chambers. A stock consumer is connected to a stock outlet of the first chamber, and stock from an outlet of the second chamber is returned to the tank via a recycle line. Means for sensing the stock level in the first chamber are provided to control valve means in the recycle line, whereby said stock level is maintained constant.

3 Claims, 1 Drawing Figure

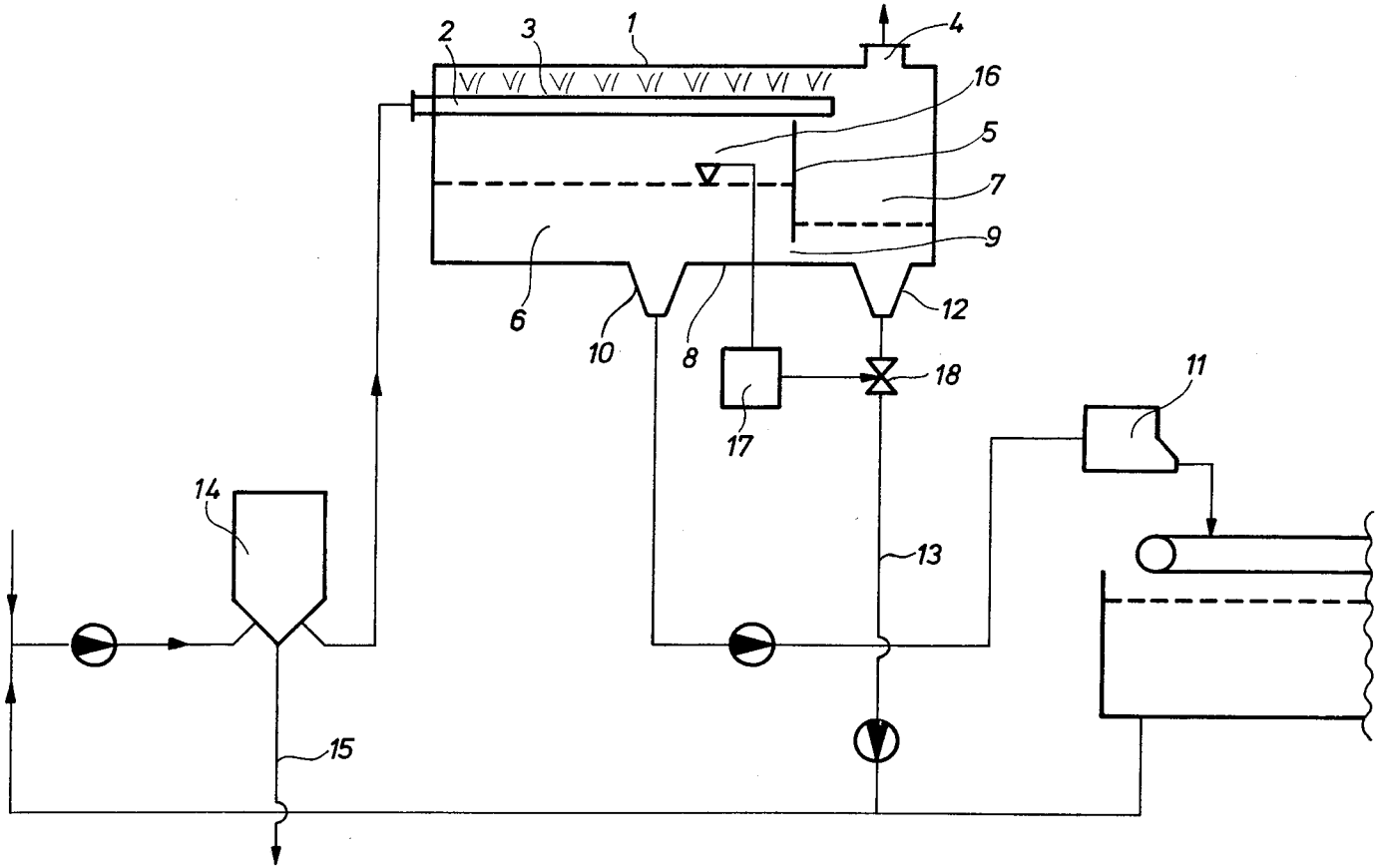
1
2
3
4
5
6
7
8
9
10
11
12
13
14
15
16
17
18

APPARATUS FOR DEGASSING PAPER STOCK

The present invention relates to a process for degassing a suspension of cellulosic fibers for papermaking (so-called stock) and comprising continuously feeding a flow of said stock into a closed tank, which is divided by a partition into a first chamber and a second chamber, equally low gas pressure being maintained in these chambers, one flow fraction of the stock being caused to flow through an outlet from the first chamber to a stock consumer, the remaining flow fraction being caused to flow from the first chamber to the second chamber and thence, via a recycle line, back to the tank. The invention also relates to apparatus for performing the process.

In papermaking the stock is degassed and is then conveyed to the wire part of a paper machine. Usually, the degassing is carried out by feeding the stock via one or a few relatively large nozzles, with diameters of about 10 cm, into an evacuated tank where a certain stock level is maintained and from which the stock is conveyed to said wire part. Maintaining this stock level constant is quite important in order to avoid a varying stock flow to the paper machine, resulting in disturbances in the paper production. From the beginning, it was attempted in the papermaking industry to control the stock level in the evacuated tank by sensing the stock level and controlling the outflow in the line through which the stock flow is conveyed to the wire part of the paper machine. However, maintaining said stock level constant by such control means proved to be quite difficult. Therefore, the stock level in the degassing tank was later controlled by means of a weir positioned within same. Such a degassing apparatus is disclosed, for example, in Swedish Patent Specification No. 317,254 (U.S. Pat. No. 3,206,917). The weir divides the degassing tank in two chambers. In the first one there is provided a "pond" of stock, from which stock is taken to the wire part of the papermachine. From the second chamber a flow of stock is discharged and recycled to the inlet device, which in this case comprises a few hydrocyclones coupled in parallel, the central light phase outlets of which are extended to end within the degassing tank relatively close to the upper wall of same. With this arrangement, the stock is spread as funnel-formed patterns from the nozzles of the light phase outlets.

The latter apparatus was an improvement compared to controlling arrangements which had previously been used, as far as the ability to maintain a constant stock level in the degassing tank is concerned. It has become obvious, however, that it suffers from certain drawbacks. The stock level is subject to wave movements caused partly by the mode of feeding stock through a relatively small number of inlet nozzles and partly by the weir means itself. Due to the unstable conditions prevailing at the edge of the weir means, because of the variation of the liquid friction with the flow conditions, the liquid surface is disturbed. Cellulosic fibers may also deposit on the weir means and thus change the stock level. Furthermore, fibers may settle in the "pond" close to the weir means, where the stock does not move substantially.

Thus, there is a demand for an improved method of degassing papermaking stock, for controlling the stock level in a degassing tank in an efficient way without risk of disturbances.

In the method of the present invention, a stock flow is caused to stream through an opening in the partition wall, and the stock level in the first chamber is sensed and maintained constant by operating a valve means in the recycle line under control of the level sensing.

An apparatus for performing the method of the invention comprises a closed tank having means for feeding the stock, the tank being connected to a device for evacuating gas in such a way that substantially equally low gas pressure is maintained in a first chamber and a second chamber. The tank is divided by a partition extending from the lower part of the tank, the first chamber being provided with a stock discharge outlet to a stock consumer, the second chamber being provided with an outlet connected to a recycle line to the tank. The recycle line is provided with a valve means and includes an opening in the partition through which stock streams from the first chamber to the second chamber, and means for sensing the stock level in the first chamber are arranged to control the valve means, depending on the stock level, in such a way that said level is maintained constant.

In one preferred embodiment of the apparatus according to the invention, the opening of the partition is positioned to extend from the bottom of the tank. In this way, the advantage is gained that the liquid flow along the bottom prevents fiber sediments from depositing, thus maintaining the bottom clean in an efficient way.

In another suitable embodiment of the new apparatus, the means for feeding the stock consists of a pipe located within the upper part of the tank and provided with a plurality of relatively small inlet nozzles directed against the adjacent wall of the tank. Thus, the stock will be evenly distributed within the degassing tank to prevent disturbances of the stock level.

The invention will now be described more in detail, reference being made to the accompanying drawing in which the single illustration is a schematic flow diagram of an apparatus for performing the process according to the invention.

In the drawing, a closed tank 1 is provided with means for feeding finely divided stock, the feeding means being in the form of an inlet pipe 2 provided with a great number of inlet nozzles 3 having relatively small diameters of about 15 mm. The tank is connected to a gas evacuating device 4 (which is not shown in detail) which maintains a substantial vacuum in tank 1. A vertical partition 5 divides tank 1 into a first chamber 6 and a second chamber 7 and is provided with an opening 9, in the form of a segment, extending from the bottom 8 of tank 1. Partition 5 leaves an upper free passageway between said chambers, so that the gas pressure is equal in the two chambers. Chamber 6 is connected through a discharge outlet 10 to the inlet box 11 of a paper machine. The second chamber 7 is connected through an outlet 12 and a recycle line 13 to inlet pipe 2, via a hydrocyclone assembly 14 through which even the incoming stock is fed to the apparatus. From hydrocyclone assembly 14, impurities are discharged through a line 15.

In chamber 6, a level sensing means 16 is positioned below the upper edge of partition 5, the level sensing means being connected to a controller 17 which, in turn, is connected to a motor-controlled valve 18 in recycle line 13.

In the operation of the apparatus, the gas evacuating means 4 maintains a substantial vacuum in the whole of tank 1 so that the gas pressure is equally low in chamber 6 and chamber 7, as partition 5 leaves a free gas passageway between the chambers. Stock is fed via hydrocyclone assembly 14 through inlet pipe 2 and is divided evenly by inlet nozzles 3 against the upper wall of tank 1. Chamber 6 is charged with stock to a predetermined level, sensed by sensing means 16. Stock is discharged through bottom discharge outlet 10 and is conveyed to inlet box 11. A stock flow streams through opening 9 into chamber 7 and further through outlet 12 down into recycle line 13 for recycling via hydrocyclone assembly 14 to inlet pipe 2. The total of the stock flow to tank 1 is thus larger than the stock flow conveyed through discharge outlet 10 to inlet box 11. The excess flow circulates through recycle line 13 and provides the control of stock level in chamber 6 by the fact that a sinking stock level gives to controller 17, via sensing means 16, a signal to direct valve 18 towards a closed position, while a rising stock level in a corresponding way causes valve 18 to open. If tank 1 is formed like a circular cylinder, which is the normal case, with a diameter D and a length L, the area of opening 9 is suitably 1 to 3% of L×D.

As shown in the drawing, the liquid level in chamber 7 is substantially lower than that in chamber 6. It will be apparent that such a condition occurs when a rising stock level acts through level sensor 16 and controller 17 to open valve 18 sufficiently so that the flow rate through recycle line 13 exceeds the flow rate through partition opening 9. This lowering of the level in chamber 7 will have the effect of restoring the level in chamber 6 to the desired level. Conversely, when the stock level falls below the deisred level in chamber 6, sensor 16 causes controller 17 to throttle the valve 18 so as to decrease the flow rate through opening 9 sufficiently to restore the desired stock in the chamber 6.

By the special provision of an opening 9 in partition 5, a system is provided which can be controlled in a much more efficient way than instrument control systems of the type previously mentioned. The new system also provides much better constancy of level, as compared to apparatus provided with weir means within the degassing tank.

We claim:

1. Apparatus for degassing a suspension of cellulosic fibers forming a stock for paper making, the apparatus comprising a closed tank having a partition extending upward from the lower part of the tank and dividing the tank into a first chamber and a smaller second chamber, each chamber having a stock discharge outlet, means for feeding the stock to the tank, said partition means having a free gas passageway at the top of the tank between the two chambers, gas evacuation means for maintaining substantially equally low gas pressures in the two chambers, a stock consumer connected to said stock outlet of the first chamber, said partition further having a restricted opening extending from the bottom of the tank for passage of stock from the first chamber to the second chamber, a recycle line for recycling stock from said stock outlet of the second chamber back to the tank, means for sensing the stock level in the first chamber, and valve means located in said recycle line and operable under control of said sensing means to maintain said stock level constant.

2. The apparatus of claim 1, in which said feeding means include a pipe located in the upper part of the tank and provided with a plurality of nozzles arranged to direct the stock against an adjacent wall of the tank.

3. The apparatus of claim 1, in which said tank is a circular cylinder having a diameter D and a length L, the area of said opening being about 3% of L times D.

* * * * *